US007819636B2

(12) United States Patent
Huang

(10) Patent No.: US 7,819,636 B2
(45) Date of Patent: Oct. 26, 2010

(54) AIR PUMP WITH IMPROVED AIR INTAKE CONTROL STRUCTURE

(75) Inventor: Tien-Chung Huang, Changhua County (TW)

(73) Assignee: Tricore Corporation, Chang Hua (TW)

( * ) Notice: Subject to any disclaimer, the term of this patent is extended or adjusted under 35 U.S.C. 154(b) by 531 days.

(21) Appl. No.: 11/636,982

(22) Filed: Dec. 12, 2006

(65) Prior Publication Data

US 2007/0140879 A1 Jun. 21, 2007

(30) Foreign Application Priority Data

Dec. 16, 2005 (TW) ..... 94222054 U

(51) Int. Cl.
*F04B 9/04* (2006.01)
*F04B 53/12* (2006.01)
*F04B 1/12* (2006.01)

(52) U.S. Cl. ..... 417/269; 417/413.1; 417/523; 417/545

(58) Field of Classification Search ..... 417/523, 417/522, 569, 472, 413.1, 269, 550; 92/48, 92/96, 99, 106, 108, 183, 71; 91/422, 498, 91/490

See application file for complete search history.

(56) References Cited

U.S. PATENT DOCUMENTS 4,515,531 A * 5/1985 Roser ..... 417/269
4,723,894 A * 2/1988 Marx ..... 417/269
4,801,249 A * 1/1989 Kakizawa ..... 417/269
5,476,367 A * 12/1995 Zimmermann et al. ..... 417/307
6,158,971 A * 12/2000 Takagi ..... 417/244
6,206,664 B1 * 3/2001 Kakizawa ..... 417/569
6,264,438 B1 * 7/2001 Fukami ..... 417/412
6,506,033 B2 * 1/2003 Fukami ..... 417/420
6,764,287 B2 * 7/2004 Yamakawa ..... 417/523
7,040,876 B2 * 5/2006 Fukami et al. ..... 417/413.1
7,377,756 B2 * 5/2008 Hori ..... 417/413.1
7,451,687 B2 * 11/2008 Lynn et al. ..... 92/12.2
2003/0031571 A1 * 2/2003 Yamakawa ..... 417/412
2003/0068234 A1 * 4/2003 Shindo ..... 417/269
2005/0047934 A1 * 3/2005 Nawa ..... 417/357
2005/0047940 A1 * 3/2005 Nawa et al. ..... 417/413.1
2007/0160485 A1 * 7/2007 Huang ..... 417/473
2008/0106071 A1 * 5/2008 Huang ..... 280/728.1

* cited by examiner

*Primary Examiner*—Devon C Kramer
*Assistant Examiner*—Nathan Zollinger
(74) *Attorney, Agent, or Firm*—Bacon & Thomas, PLLC

(57) ABSTRACT

An air pump operably by a motor to pump air is disclosed to include a body, an airbag unit, which is mounted in the body has multiple airbags each having an air chamber and an air inlet, a lifting mechanism rotatable by the motor to move the airbags to pump air, a plurality of air intake control valves movably set between the air inlet of each airbag and respective air inlets of the lifting mechanism to control the air passage between the air inlet of each airbag and the air inlets of the lifting mechanism subject to the operation status of the airbags, and an exhaust structure coupled to the airbag unit for exhaust of air from the airbags.

9 Claims, 8 Drawing Sheets

AIR PUMP WITH IMPROVED AIR INTAKE CONTROL STRUCTURE

BACKGROUND OF THE INVENTION

1. Field of the Invention

The present invention relates to air pumps and more particularly, to an air pump having an improved air intake control structure.

2. Description of the Related Art

A conventional air pump is known comprising an airbag unit, which defines therein a plurality of air chambers, a partition plate, which has exhaust holes and air inlets respectively disposed in communication with the air chambers, a control valve, which has air inlet control valve flaps and exhaust control valve flaps corresponding to the exhaust holes and the air inlets, a crank, which has air inlets corresponding to the air inlet control valve flaps and the exhaust control valve flaps. When started the motor, the airbags are moved to suck in air through the air inlets and to force air out of the exhaust holes.

The aforesaid prior art air pump has a complicated structure formed of a big number of parts, resulting in a complicated installation procedure and high manufacturing cost. Further, this design of air pump is not convenient in use.

SUMMARY OF THE INVENTION

The present invention has been accomplished under the circumstances in view. It is one object of the present invention to provide an air pump, which has a simple air intake structure. It is another objects of the present invention to provide an air pump, which has the air intake structure provided at the bottom side convenient for intake of air.

To achieve these and other objects of the present invention, the air pump is coupled to a motor and adapted to pump air upon rotation of the motor. The air pump comprises a body; an airbag unit mounted in the body, the airbag unit comprising at least one airbag, the at least one airbag each having an air chamber and an air inlet; a lifting mechanism rotatable by the motor, the lifting mechanism having at least one arm respectively connected to the at least one airbag and adapted to move the at least one airbag to pump air, and at least one air inlet in air communication with the air inlet of each airbag; air intake control valve means movably set between the air inlet of each airbag and the at least one air inlet of the lifting mechanism to control the air passage between the air inlet of each airbag and the at least one air inlet of the lifting mechanism; and an exhaust structure coupled to the airbag unit for exhaust of air from the at least one airbag.

DETAILED DESCRIPTION OF THE INVENTION

Figure 1:
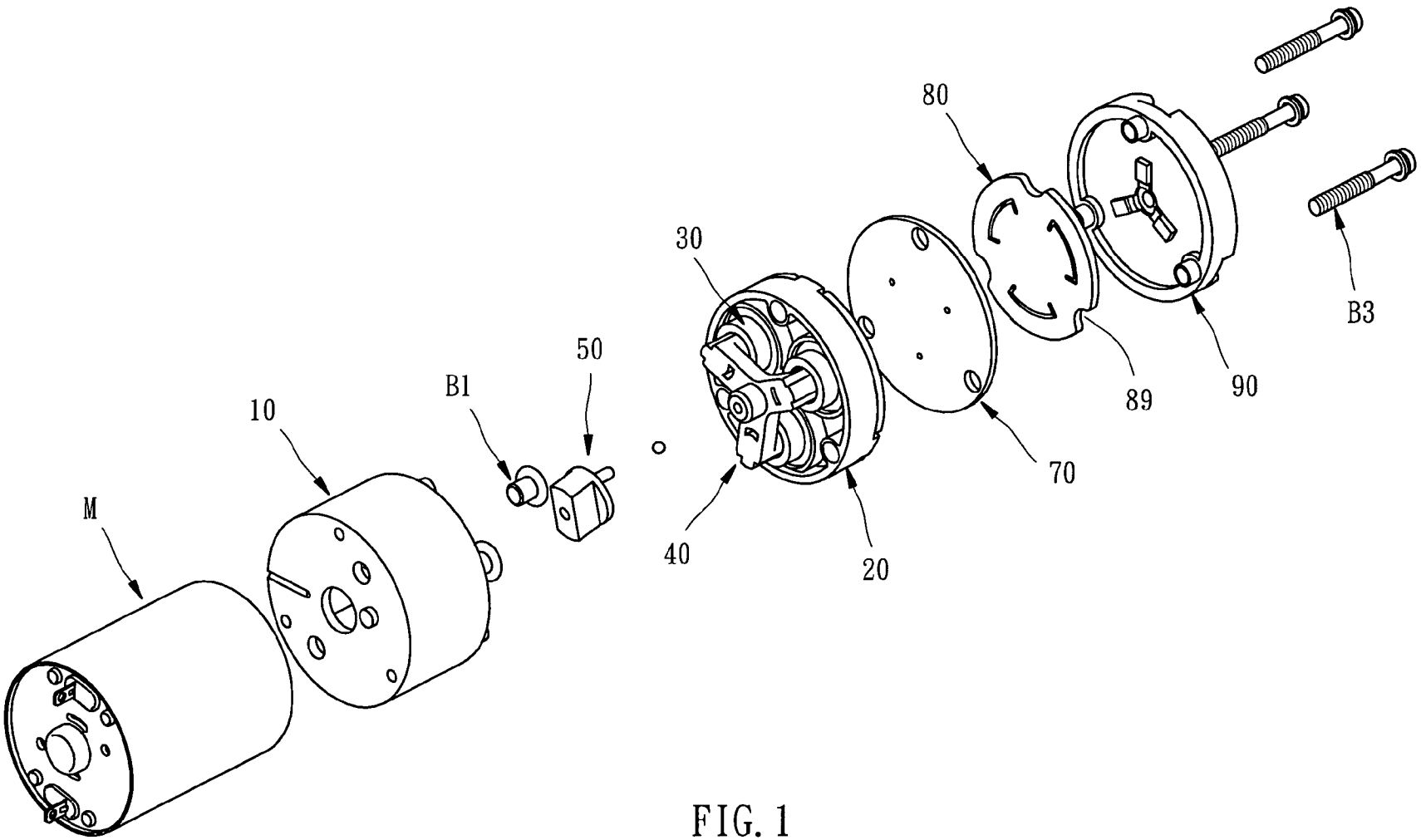
FIG. 1 is an exploded view of an air pump in accordance with a first embodiment of the present invention.
Figure 2:
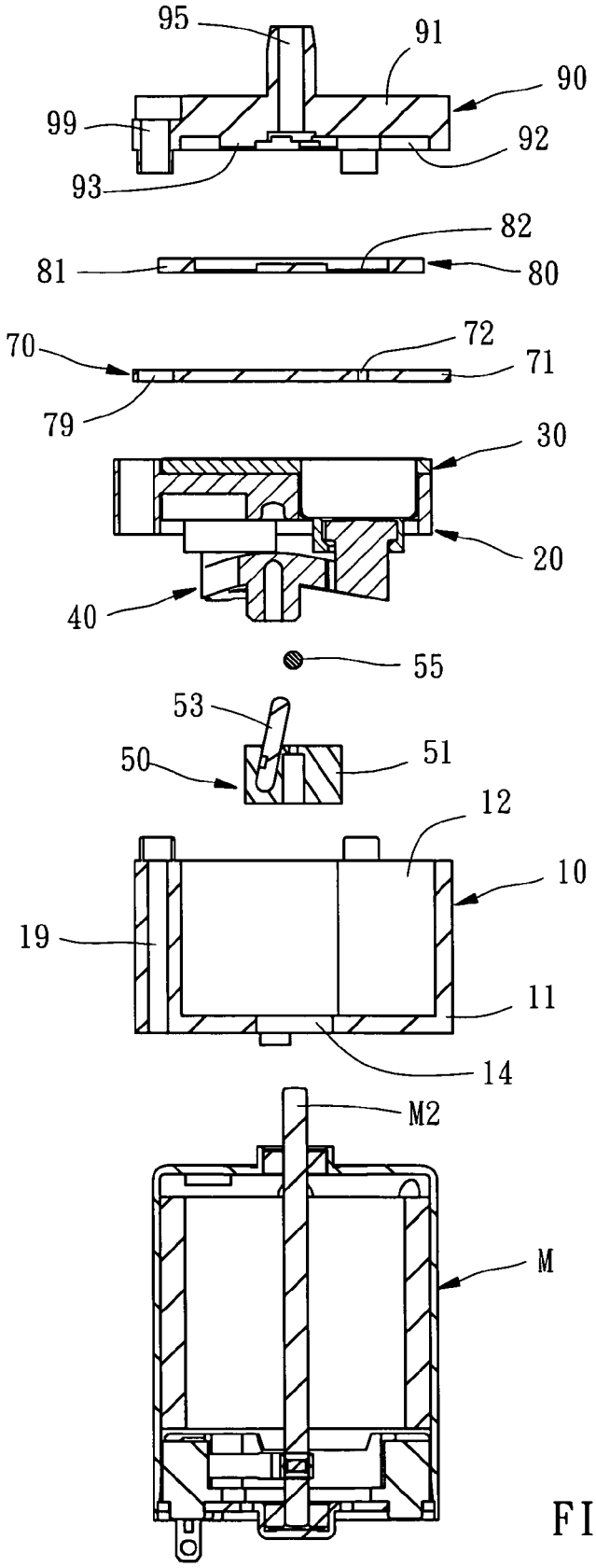
FIG. 2 is a plain view in an exploded status of the air pump according to the first embodiment of the present invention.
Figure 3:
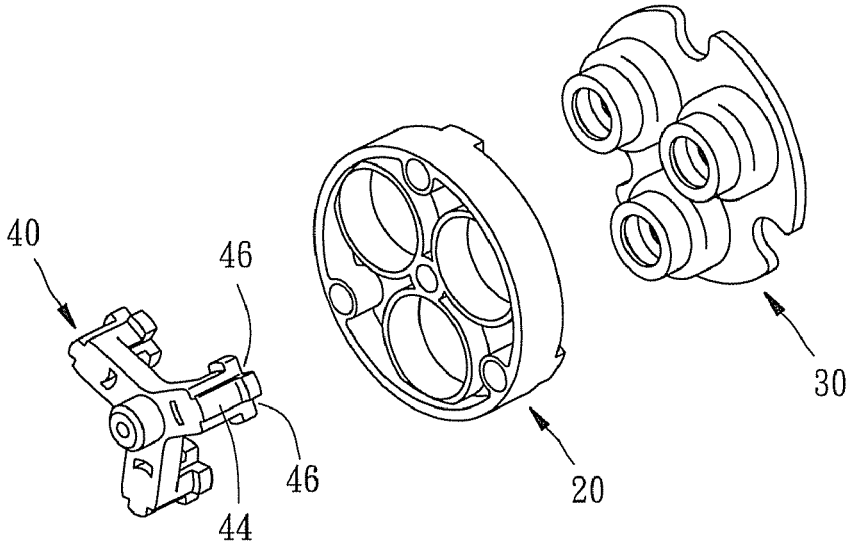
FIG. 3 is an exploded view of a part of the air pump according to the first embodiment of the present invention.
Figure 4:
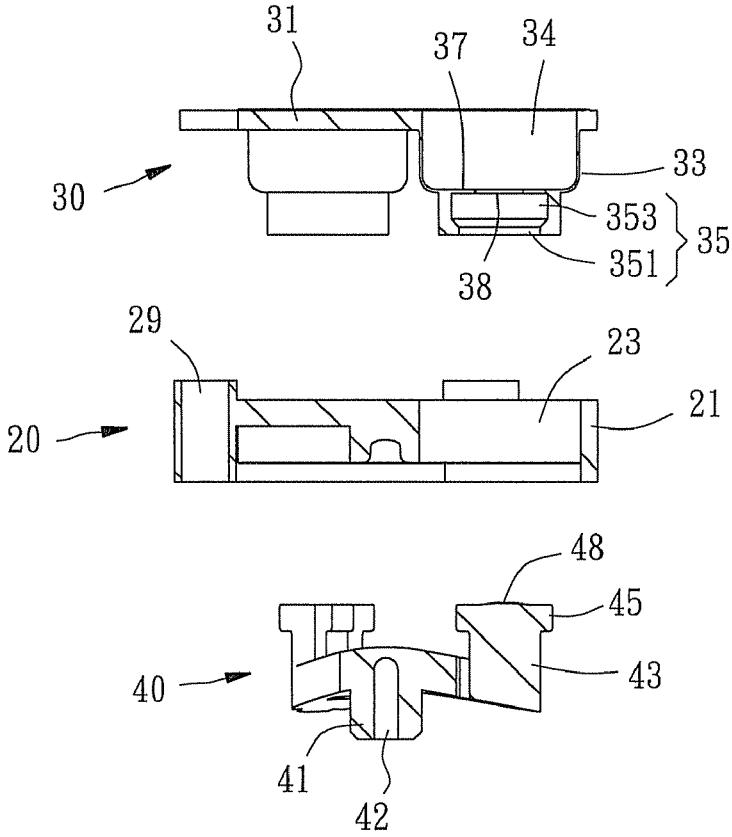
FIG. 4 is a sectional view in an exploded status of a part of the air pump according to the first embodiment of the present invention.

Referring to FIG. 16, an air pump in accordance with a first embodiment of the present invention is shown movable with the shaft M2 of a motor M to pump air. The air pump comprises a body formed of a holder 10 and a cover 20, an airbag unit 30, a lifting mechanism formed of a crank 40 and a rotary member 50, and an exhaust unit formed of a partition plate 70 and an exhaust control valve 80 and an exhaust cap 90.

The holder 10 is affixed to the motor M with two screw bolts B1, having a holder body 11 defining a receiving open chamber 12, a through hole 14 cut through the center of the bottom wall thereof in communication with the receiving open chamber 12 for the passing of the shaft M2 of the motor M, and three mounting portions (mounting holes) 19.

The cover 20 has a cover body 21 covered on the holder body 11 of the holder 10 to close the receiving open chamber 12, three mounting portions (mounting holes) 29 formed in the cover body 21 corresponding to the mounting portions 19 of the holder 10, and three airbag receiving portions (airbag receiving holes) 23 formed in the cover body 21.

The airbag unit 30 has a mounting plate 31, and three airbags 33 connected to the mounting plate 31 and respectively received in the airbag receiving portion 23 of the cover 20. Each airbag 33 has an air chamber 34, a coupling portion 35, an air inlet 38, and an integrated valve flap 37 which formed an air intake control valve adapted to control the air inlet 38. The coupling portion 35 is formed of a small-diameter hole 351 and a large-diameter hole 353 located between the small-diameter hole 351 and the air inlet 38.

The crank 40 has a shaft 41, which has an axial hole 42, three arms 43 extended from the shaft 41 and respectively connected to the coupling portions 35 of the airbags 33 of the airbag unit 30. Each arm 43 has a head 45 coupled to the coupling hole 35 of one airbag 33, a plurality of ribs 44 longitudinally formed on the periphery of the arm 43, a plurality of grooves 46 formed on the periphery of the arm 43 and located between the ribs 44, and a bearing surface 48 formed on the top side of the head 45 for stopping against the valve flap 37 of the associating airbag 33. The head 45 of the arm 43 is inserted into the large-diameter hole 353 of the coupling portion 35 of the airbag 33.

The rotary member 50 has a base 51 connected to the shaft M2 of the motor M for rotation with the shaft M2, and an oblique shaft 53 obliquely extended from the base 51 and coupled with a steel ball 55 to the axial hole 42 of the shaft 41 of the crank 40.

The partition plate 70 has a body 71 connected to the top side of the mounting plate 31 of the airbag unit 30, three exhaust holes 72 respectively disposed in air communication with the air chambers 34 of the airbags 33 of the airbag unit 30, and three mounting portions 79 respectively fastened to the mounting portions 29 of the cover 20.

The exhaust control valve 80 has a valve body 81 fastened to the partition plate 70, three smoothly arched valve flaps 82 respectively protruded from the valve body 81 and adapted to close/open the exhaust holes 72 of the partition plate 70, and three mounting portions 89.

The exhaust cap 90 has a cap body 91, a chamber 92 defined in the cap body 91 corresponding to the valve flaps 82 of the exhaust control valve 80, three press portions 93, an exhaust hole 95 in air communication with the chamber 92, and three mounting portions 99.

Further, three screw bolts B3 are inserted through the mounting portions 99, 89, 79 and 29 of the exhaust cap 90, exhaust control valve 80, partition plate 70 and cover 20 and fastened to the mounting portions 19 of the holder 10 to affix the related parts together.

Figure 5:
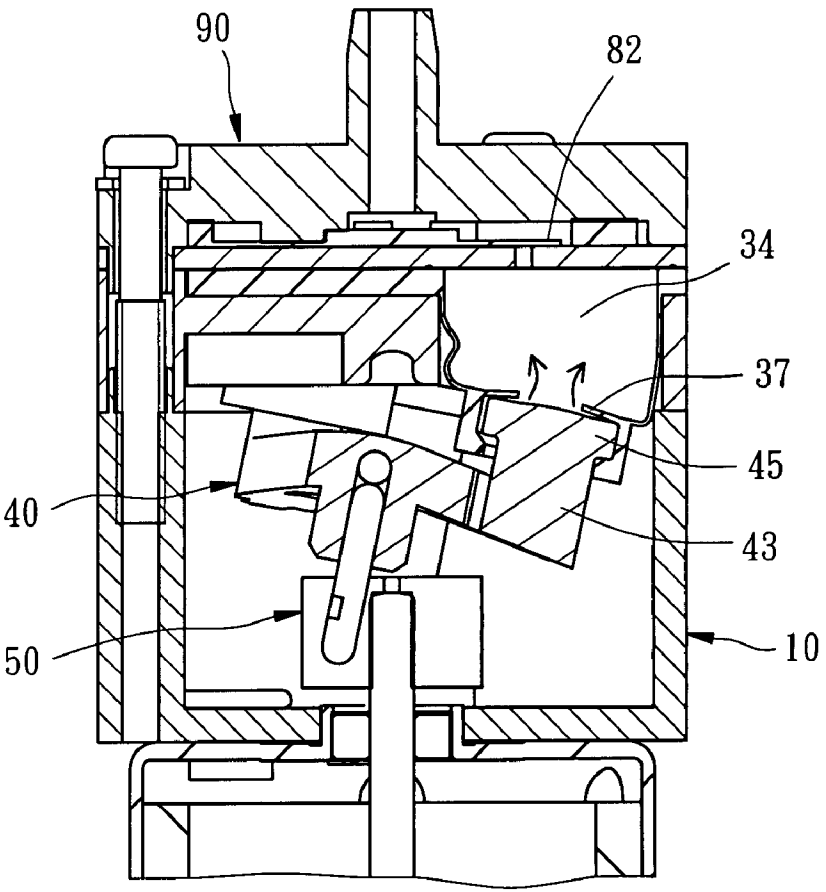
FIG. 5 is a sectional assembly view of the air pump according to the first embodiment of the present invention.

Referring to FIG. 5, when the motor M is started to rotate the rotary member 50, the oblique shaft 53 of the rotary member 50 drives the crank 40, causing the arms 43 of the crank 40 to reciprocate the airbags 33 alternatively.

Referring to FIG. 5 again, when one airbag 33 is moved downwards, it breathes in air, and the associating valve flap 82 is forced by the suction force to close the associating exhaust hole 72 of the partition plate 70, and at the same time the associating valve flap 37 curved upwards and spaced from the head 45 of the associating arm 43 of the crank 40 for allowing air to pass through the associating grooves 46 into the associating air chamber 34.

Figure 6:
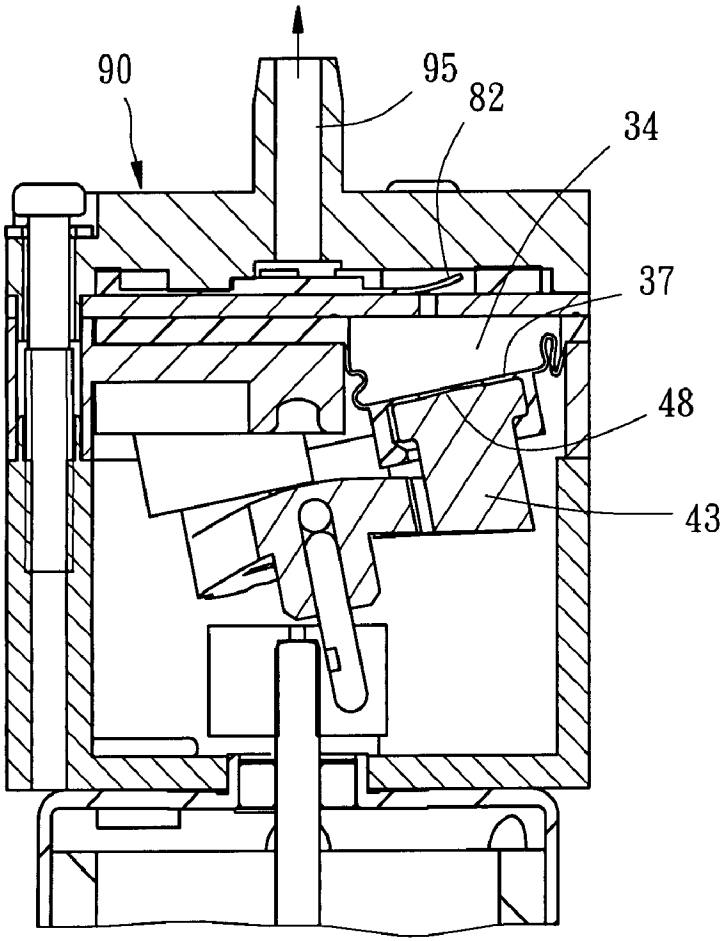
FIG. 6 is similar to FIG. 5 but showing the air pump operated.

On the contrary, as shown in FIG. 6, when one airbag 33 is moved upwards, the associating valve flap 37 is forced by air pressure to stop at the head 45 of the associating arm 43 of the crank 40 and to further block the passage between the associating grooves 46 and the associating air chamber 34, and at the same time the associating valve flap 82 is forced by the air pressure to open the associating exhaust hole 72 of the partition plate 70 for enabling air to pass through the associating exhaust hole 72 of the partition plate 70 and the chamber 92 of the exhaust cap 90 to the outside via the exhaust hole 95.

Figure 7:
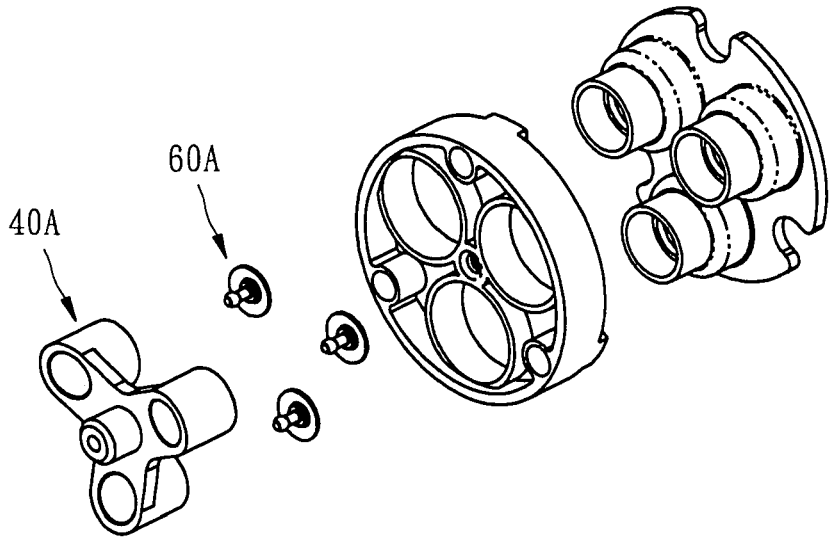
FIG. 7 is an exploded view of a part of an air pump in accordance with a second embodiment of the present invention.
Figure 8:
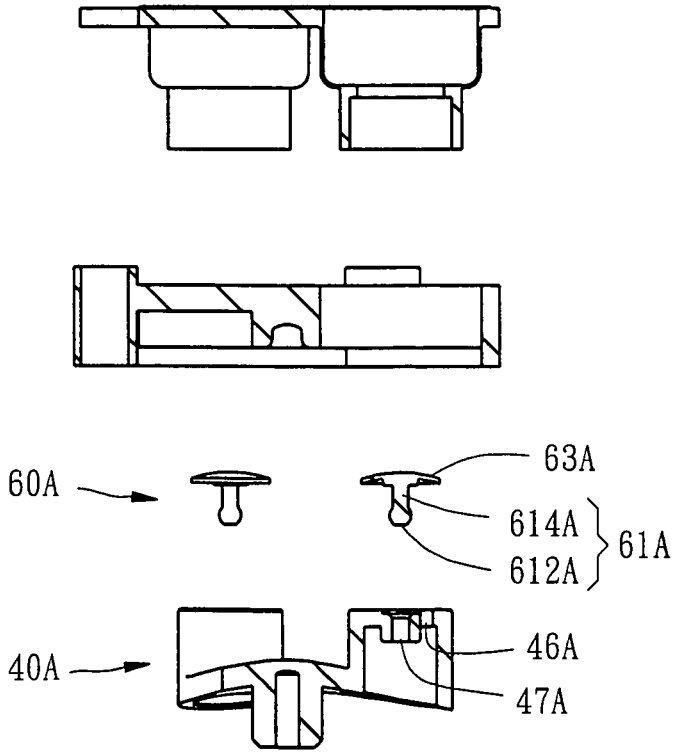
FIG. 8 is a sectional view in an exploded status of a part of the air pump according to the second embodiment of the present invention.

FIGS. 7 and 8 show an air pump in accordance with a second of the present invention. This embodiment includes three air intake control valves 60A. The crank 40A has a plurality of installing portions 47A, and a plurality of air inlets 46A corresponding to the installing portions 47A. Each air intake control valve 60A has a mounting portion 61A fastened to one installing portion 47A of the crank 40A, and a valve flap 63A adapted to close/open one air inlet 46A of the crank 40A. The mounting portion 61A has a head 612A and a neck 614A connected between the valve flap 63A and the head 612A. The neck 614A is inserted into the installing portion 47A of the crank 40A. The head 612A is located at one side of the installing portion 47A away from the valve flap 63A.

Figure 9:
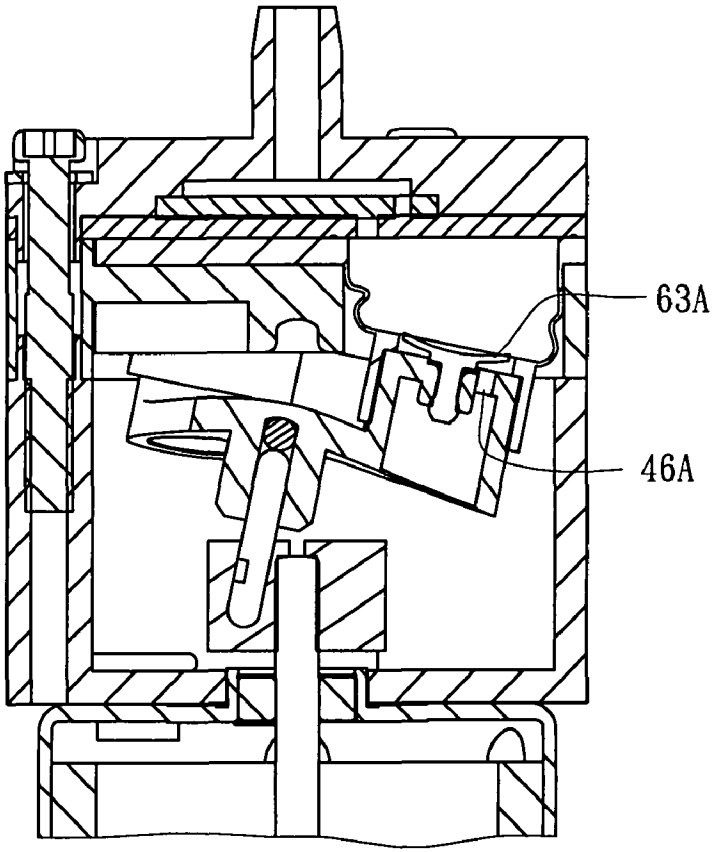
FIG. 9 is a sectional assembly view of the air pump according to the second embodiment of the present invention.
Figure 10:
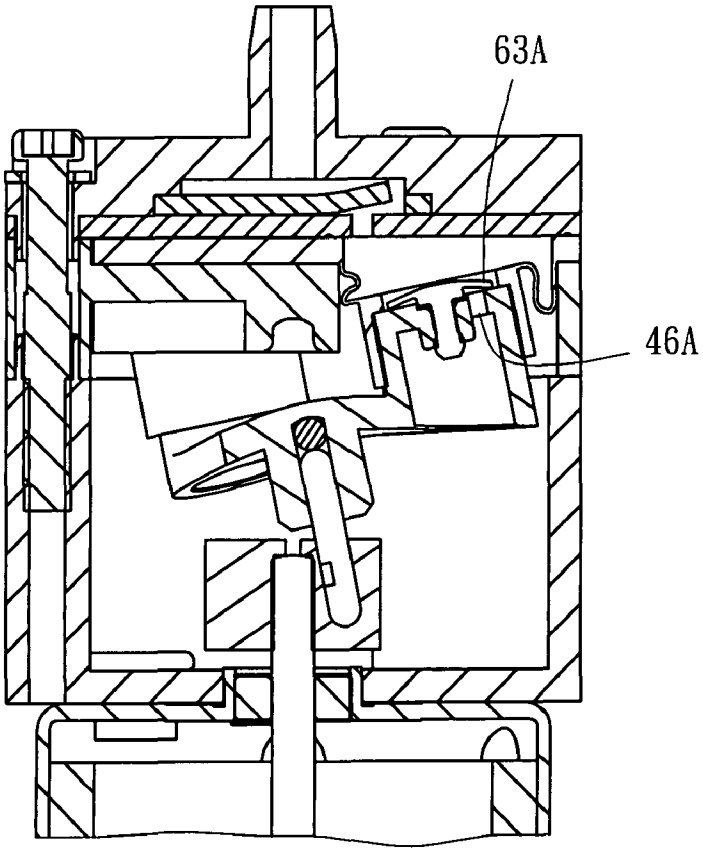
FIG. 10 is similar to FIG. 9 but showing the air pump operated.

Referring to FIG. 9, the air inlets 46A of the crank 40A are adapted to suck in air. When one air inlet 46A is stopped against the associating valve flap 63A of the air intake control valve 60A, the associating valve flap 63A is deformed, and the air inlet 46A is opened for letting air to pass. On the contrary, as shown in FIG. 10, during exhaust stroke, the valve flaps 63A are respectively closed on the associating air inlets 46A to block the air inlets 46A, for enabling air to exhaust upwards.

Figure 11:
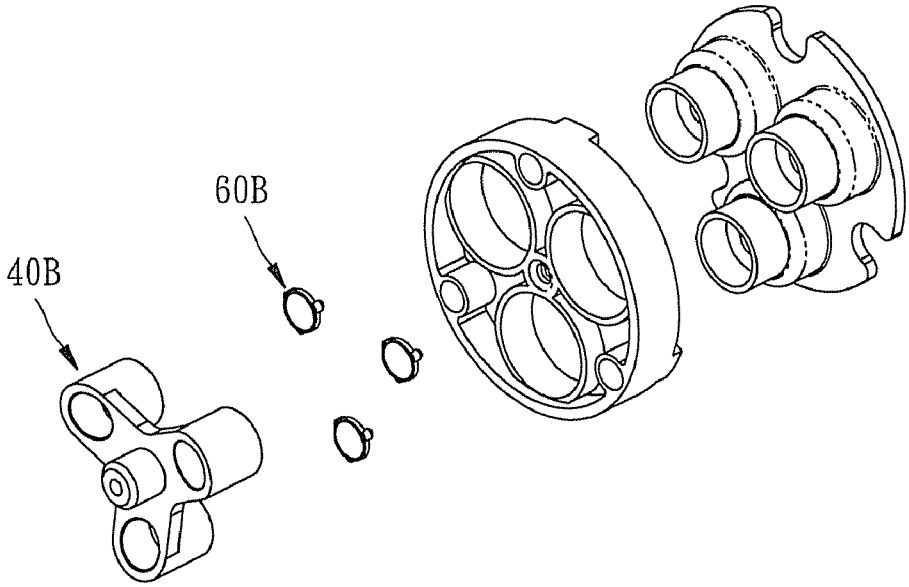
FIG. 11 is an exploded view of a part of an air pump in accordance with a third embodiment of the present invention.
Figure 12:
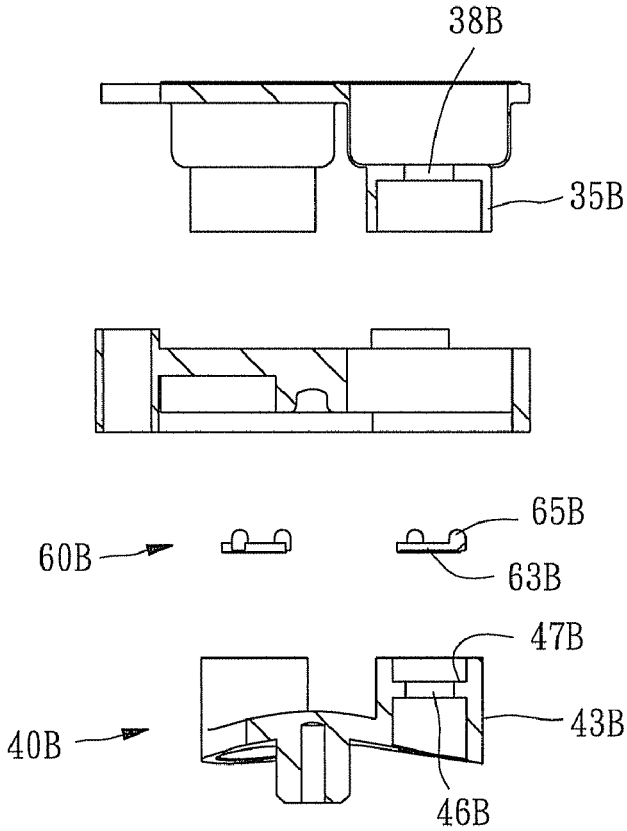
FIG. 12 is a sectional view in an exploded status of a part of an air pump in accordance with the third embodiment of the present invention.

FIGS. 11 and 12 show an air pump in accordance with a third embodiment of the present invention. According to this embodiment, the crank 40B has three arms 43B. Each arm 43B has an installing portion 47B and an air inlet 46B formed on the installing portion 47B. The arms 43B of the crank 40B are inserted into the inner of the coupling portions 35B of the airbags. Each arm 43B forms a connecting chamber 49B with one corresponding airbag. The connecting chamber 49B is in air communication between the air inlet 38B of the airbag and the air inlet 46B of the arm 43B. A plurality of air intake control valves 60B are located in the connecting chambers 49B. Each air intake control valves 60B has a valve flap 63B and a floating portion 65B formed integral with the valve flap 63B. The floating portion 65B has a plurality of protrusions.

Figure 13:
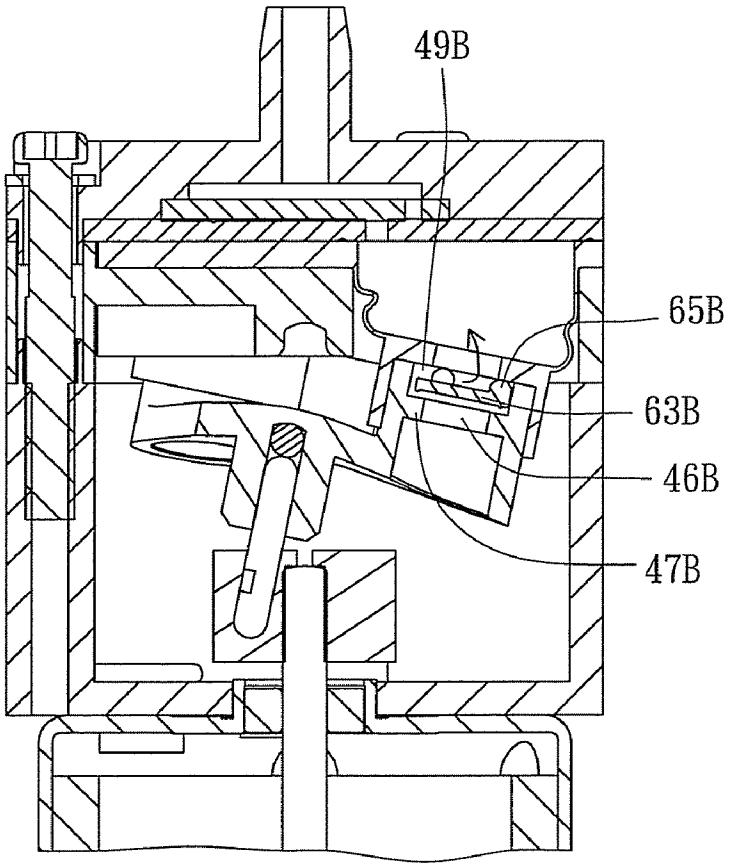
FIG. 13 is a sectional assembly view of the air pump according to the third embodiment of the present invention.
Figure 14:
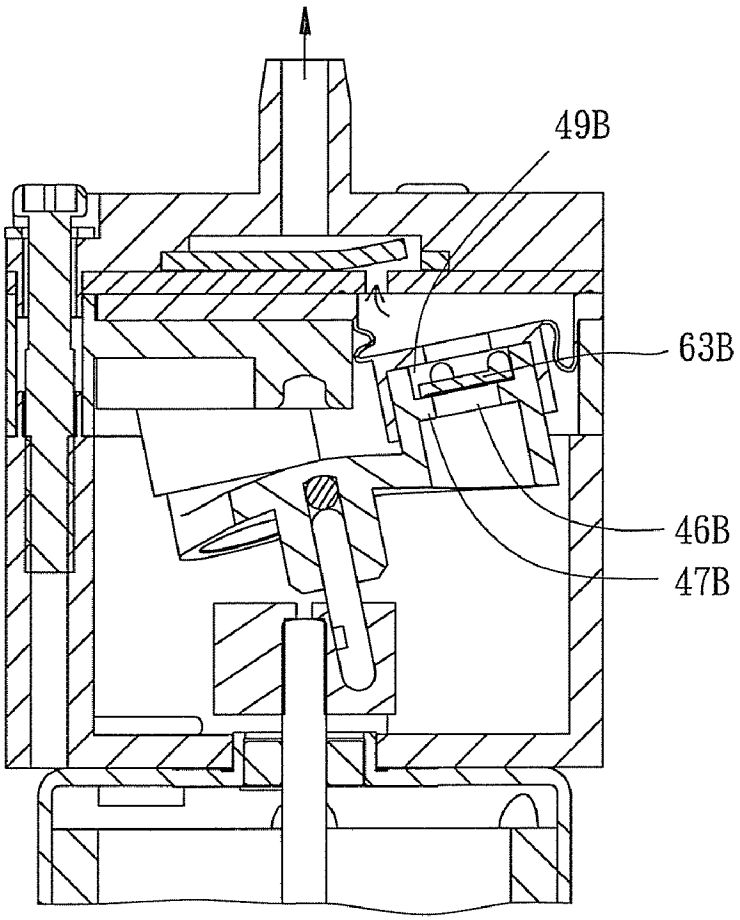
FIG. 14 is similar to FIG. 13 but showing the air pump operated.

As shown in FIG. 13, when the air intake control valve 60B is in a high position, the protrusions 65B stop against the bottom of the airbag for airflow to pass around the protrusions. As shown in FIG. 14, when the air intake control valve 60B is in a low position, the valve flap 63B covers the air inlet 46B of the arm 43B.

In the aforesaid various embodiments of the present invention, the lifting mechanism can be fastened to the airbag unit by a plug joint, hook joint or rivet joint, or with an adhesive, or by means of any of a variety of connection means.

As indicated above, the air pump of the present invention has the following benefits:

1. The air intake structure of the air pump is provided at the bottom side convenient for intake of air. It can be tightly sealed during the exhaust stroke.

2. The arrangement of the intake structure of the air pump is simple.

What is claimed is:

1. An air pump coupled to a motor and adapted to pump air upon rotation of said motor, the air pump comprising:

a body;

an airbag unit mounted in said body, said airbag unit comprising at least one airbag, said at least one airbag each having an air chamber, an air inlet and a coupling portion, the coupling portion including a hole with a small-diameter section and a large-diameter section formed therein, the large-diameter section located between the small-diameter section and the air inlet;

a lifting mechanism rotatable by said motor, said lifting mechanism having at least one arm respectively connected to the coupling portion of said at least one airbag and adapted to move said at least one airbag to pump air, said at least one arm having a head inserted into the large-diameter hole of the coupling portion of said at least one airbag, a plurality of ribs longitudinally formed on the periphery of the arm, and at least one groove formed on the periphery of the arm and located between the ribs;

air intake control valve means movably set between the air chamber of each of said at least one airbag and the at least one groove of said lifting mechanism to control the air passage between the air chamber of each of said at least one airbag and the at least one groove of said lifting mechanism; and an exhaust structure coupled to said airbag unit for exhaust of air from said at least one airbag.

2. The air pump as claimed in claim 1, wherein said air intake control valve means is connected to said airbag unit.

3. The air pump as claimed in claim 2, wherein said air intake control valve means is formed integral with said airbag unit.

4. The air pump as claimed in claim 1, wherein said air intake control valve means is connected to said lifting mechanism.

5. The air pump as claimed in claim 4, wherein said lifting mechanism has at least one installing portion, and said air intake control valve means has a mounting portion and a valve flap, the mounting portion having a head and a neck connected between the valve flap and the head, the neck being inserted into said at least one installing portion of said lifting mechanism, the head being located at one side of said at least one installing portion away from the valve flap.

6. The air pump as claimed in claim 4, wherein said air intake control valve means has a valve flap covered on the air inlet of the lifting mechanism and a plurality of protrusions formed integrally with the valve flap.

7. The air pump as claimed in claim 1, wherein the at least one groove of said lifting mechanism is respectively formed in the periphery of said lifting mechanism.

8. The air pump as claimed in claim 1, wherein the at least one groove of said lifting mechanism is respectively formed on the inside of said lifting mechanism.

9. An air pump coupled to a motor and adapted to pump air upon rotation of said motor, the air pump comprising:

a body;

an airbag unit mounted in said body, said airbag unit comprising at least one airbag, said at least one airbag each having an air chamber, an air inlet and a coupling portion;

a lifting mechanism rotatable by said motor, said lifting mechanism having at least one arm respectively inserted inside the coupling portion of said at least one airbag and adapted to move said at least one airbag to pump air, said at least one arm each having an air inlet, said at least one arm forming a connecting chamber with said at least one airbag, the connecting chamber being in air communication between the air inlet of the airbag and the air inlet of the arm;

at least one air intake control valve respectively located in the connecting chamber of said at least one arm, said at least one air intake control valve having a valve flap and a plurality of protrusions formed integrally with the valve flap, the air intake control valve capable of moving between a high position and a low position, the valve flap covering the air inlet of the arm when the air intake control valve is in the low position, and the protrusions stopping against the bottom of the airbag when the air intake control valve is in the high position, allowing airflow to pass between the protrusions; and an exhaust structure coupled to said airbag unit for exhaust of air from said at least one airbag.

* * * * *